United States Patent [19]

Hatanaka

[11] 4,260,115

[45] Apr. 7, 1981

[54] DOCUMENT SHREDDER

[75] Inventor: Takefumi Hatanaka, Matsudo, Japan

[73] Assignee: Lifewell Corporation, Tokyo, Japan

[21] Appl. No.: 961,676

[22] Filed: Nov. 17, 1978

[30] Foreign Application Priority Data

Nov. 11, 1978 [JP] Japan ..... 53/124088

[51] Int. Cl.[3] ..... B02C 18/22; B02C 18/44

[52] U.S. Cl. ..... 241/236; 83/500; 83/664

[58] Field of Search ..... 241/167, 236; 83/500–503, 664

[56] References Cited

U.S. PATENT DOCUMENTS

| | | | |
|---|---|---|---|
| 1,178,386 | 4/1916 | Edwards | 241/236 X |
| 2,770,302 | 11/1956 | Lee | 83/500 X |
| 3,960,335 | 6/1976 | Haberle | 241/236 |
| 4,018,392 | 4/1977 | Wagner | 241/236 X |

*Primary Examiner*—Howard N. Goldberg
*Attorney, Agent, or Firm*—Robert E. Burns; Emmanuel J. Lobato; Bruce L. Adams

[57] ABSTRACT

A document shredder having first and second rotary cutting disks alternatively arranged and held in shredding engagement with one another to shred waste material into strips, first spacer members disposed in first gaps formed between the first rotary cutting disks, and second spacer members disposed in second gaps formed between the second rotary cutting disks. The first stationary cutting members have cutting edges held in shredding engagement with outer peripheries of the second rotary cutting disks in the first gaps to cut the strips into chip fragments in the first gaps. The second spacer members have cutting edges held in shredding engagement with outer peripheries of the first rotary cutting disks in the second gaps to cut the strips into chip fragments in the second gaps.

3 Claims, 2 Drawing Figures

DOCUMENT SHREDDER

BACKGROUND OF THE INVENTION

This invention relates to a document shredder for waste materials, and more particularly to a shredder mechanism for shredding intelligence data such as all types of waste documents, drawings and microfilm, waste matter such as newspapers, magazines, books, bankbooks, plastics, rubber and leather, and other kinds of unnecessary material in sheet-like form such as asphalt or the like.

In governmental, banking and industrial circles the destruction and disposal of important confidential documents and other unnecessary papers has been accomplished by finely cutting the waste documents into strips by means of a document shredder in order to preclude the danger of intelligence leaks. However, there is the possibility that the content of the waste documents can be reconstructed since characters and lines remain on these strips. In an effort to overcome this shortcoming, U.S. Pat. Nos. 3,396,914 and 3,529,782 disclose a shredder comprising a feed drum composed of a plurality of disks each having teeth about the periphery thereof, and a shredding drum consisting of a disk having choppers about the periphery thereof, the shredder thus being adapted to shred unnecessary documents into small chip-like fragments. The shredding drum rotates at an extremely high speed with respect to the feed drum and therefore develops a small torque when rotating. Accordingly, the number of sheets of unnecessary documents which can be processed at one time is limited, a disadvantage in that the efficiency of operation is unsatisfactory. The shredder is also noisy since the shredding drum choppers strike the documents at high speed.

U.S. Pat. No. 3,860,180 offers a solution to these problems through the disclosure of a shredder that employs a pair of shredding members each comprising a rotary blade having notches spirally formed on the outer periphery thereof. According to this system, unnecessary documents are finely cut into chip-like fragments by bringing a nose adjacent to a notch of one rotary blade into engagement with the outer periphery of the other rotary blade. Since the documents in this shredder are torn transversely by the nose edge, the documents can not be reliably torn into chip-like fragments but will instead tend to be cut into elongated strips whenever a large number of sheets are introduced or whenever they possess a large tensile strength. There is thus the strong possibility of intelligence leaks since characters or entire sentences remain on these long strips as mentioned above. To improve upon this defect it has been proposed that a groove be provided ahead of the rotary blade notch and that the strips be made to engage with the groove to thus be pulled and torn into pieces. Nevertheless, this expedient has not proved effective. In addition, for the reasons stated above, a shredder of this type does not possess the capability of shredding into the form of chips materials which exhibit a high tensile strength, such as microfilm, plastics, rubber and leather.

SUMMARY OF THE INVENTION

It is therefore an object of the present invention to provide a document shredder capable of efficiently shredding in a highly reliable manner all kinds of waste materials into chips of predetermined dimensions by means of an extremely simple construction.

It is another object of the present invention to provide a shredder capable of reliably shredding waste documents into extremely small chip-like fragments so as to make it completely impossible to restore top-secret or important confidential documents of a governmental or industrial nature once these documents have been processed and discarded.

DESCRIPTION OF THE PREFERRED EMBODIMENT

Hereinafter a shredder in accordance with the present invention will be described in terms of shredding a material having a sheet-like form. However, it is to be understood that the shredder is in no way limited to processing sheet-like materials and can be utilized to destroy a wide variety of waste materials as described above.

Figure 1:
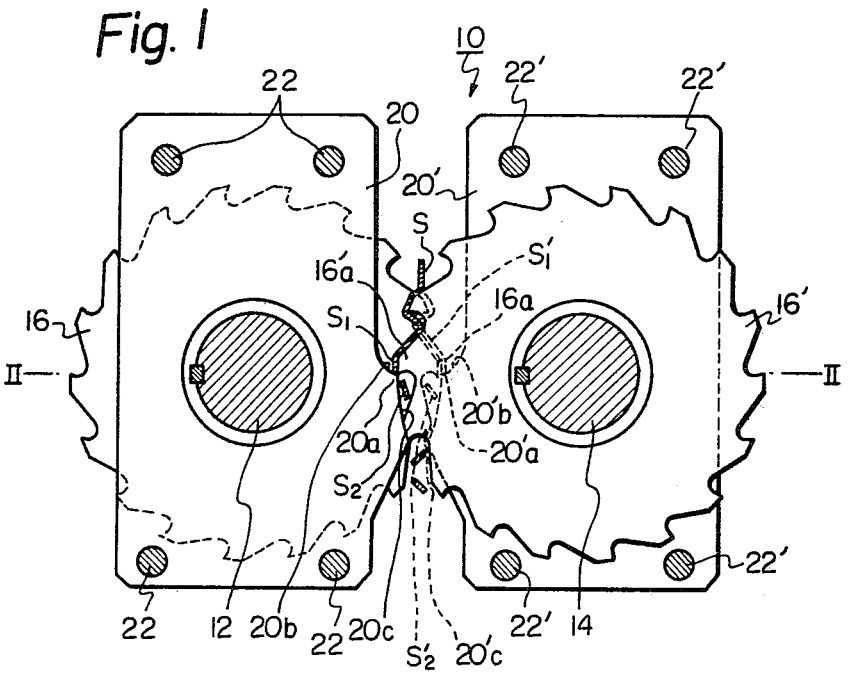
FIG. 1 is a front view of a principal portion of a document shredder for processing waste materials in accordance with the present invention.
Figure 2:
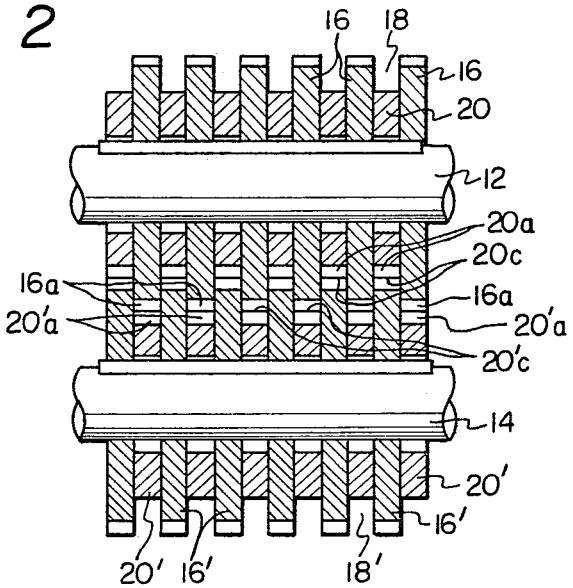
FIG. 2 is a cross-sectional view taken along the line II—II of FIG. 1.

FIG. 1 illustrates a preferred embodiment of a document shredder in accordance with the present invention, and FIG. 2 is a cross-sectional view taken along the line II—II of FIG. 1. The document shredder 10 includes a pair of rotary shafts 12, 14 disposed in parallel and rotatably driven in mutually opposite directions by suitable drive means (not shown) such as a motor. As can be more clearly seen in FIG. 2, a plurality of rotary disks 16, 16' are axially disposed along each of the shafts 12, 14 and secured thereto by keys or other suitable means. The rotary disks 16, 16' are alternatively arrayed along the axial direction in a partially overlapping manner such that a portion of the side surface of one disk abuts against a portion of the side surface of another, with gaps 18, 18' being formed between adjacent rotary disks 16, 16' and having approximately the same width as each disk. Formed about the outer periphery of each rotary disk are a plurality of suitably spaced shredding blades 16*a*, 16'*a* disposed so as to cut into both sides of a sheet-like material S at approximately the same time. However, it is also permissible to arrange the rotary disks 16, 16' in such a manner that the sheet-like material is simultaneously cut into by the edges of the shredding blades on one rotary disk and the outer periphery of the other rotary disk.

Stationary cutting members comprising spacers 20, 20' are disposed in respective gaps 18, 18'. These spacer members 20, 20' are secured to the disintegrator frame (not shown) by stationary shafts 22, 22' or other suitable means. Spacer members 20, 20' include, respectively, engaging surfaces 20*c*, 20'*c* that engage with the outer peripheries of shredding blades 16'*a*, 16*a* on the opposing rotary disks 16', 16, and at least one cutting edge 20*a*, 20'*a* provided above the respective engaging surfaces 20*c*, 20'*c*. The cutting edges 20*a*, 20'*a* engage with the outer peripheries of shredding blade 16'*a*, 16*a* on the opposing rotary disks 16', 16 in the gaps 18, 18'.

As depicted in FIG. 1 the stationary cutting members 20, 20' further include respective guiding surfaces 20*b*, 20'*b* for guiding the sheet-like material S to the blade portions 20*a*, 20'*a* in gaps 18, 18'.

In accordance with this construction the sheet-like material S is longitudinally cut into strips $S_1$, $S'_1$ by the shredding blades 16*a*, 16'*a* of the rotary disks 16, 16'. The lower portions of the strips $S_1$, $S'_1$ are fed between the cutting edges 20*a*, 20'*a* of the spacer members and the opposing shredding blades 16'*a*, 16*a* of the rotary disks 16', 16 in the gaps 18, 18' by means of the guiding surfaces 20*b*, 20'*b* of the respective spacer members 20, 20'. The strips $S_1$, $S'_1$ are then finely and reliably cut into chip-like fragments $S_2$, $S'_2$ since the shredding blades 16'*a*, 16*a* engage with respective cutting edges 20*a*, 20'*a* of spacer members 20, 20' in the gaps 18, 18'. The strips $S_1$, $S'_1$ are cut into the chip-like fragments $S_2$, $S'_2$ in an extremely reliable manner since the strips are guided in the direction of the cutting edges 20*a*, 20'*a* without fail by the guiding surfaces 20*b*, 20'*b* of spacer members 20, 20' in the gaps 18, 18' and further because the shredding blades 16'*a*, 16*a* of the rotary disks engage with the opposing cutting edges of respective spacer members 20, 20' in gaps 18, 18'. Moreover, outstanding effects are obtained in that waste materials can be shredded into chips of a small size not formerly attainable in the prior art disintegrators. This is accomplished by arranging the pitch of the shredding blades such that the cutting edges of the spacer members are set at the upper side of the small rotary disks, that is, such that the cutting edges are set close to the point at which the shredding blades 16*a*, 16'*a* of the rotary disks 16, 16' initially engage.

Although the present invention has been described with respect to a preferred embodiment as illustrated in the drawings, a number of modifications can be made without departing from the spirit or scope of the invention. For example, the shredding blades of the rotary disks 16, 16' may have various configurations other than the one shown depending on the type of waste material to be processed. The spacer members 20, 20' are also not limited to the configuration illustrated but may be modified to provide any other shape. While each spacer member 20, 20' was provided with only one cutting edge 20*a*, 20'*a*, respectively, as shown in the drawings, it is to be understood that one blade member or a plurality of blade members can be formed on the engaging surfaces 20*c*, 20'*c* of the spacer members.

What is claimed is:

1. A document shredder for cutting sheets of documents into small fragments, comprising:

first and second parallel shafts mounted for rotation in opposite directions;

a first plurality of discs fixed on said first shaft for rotation with said first shaft and spaced at intervals along the length of said first shaft, each of said discs having a plurality of shredding blades peripherally mounted thereon and spaced circumferentially thereof;

a second plurality of discs fixed on said second shaft for rotation with said second shaft and spaced at intervals along the length of said second shaft, each of said discs having a plurality of shredding blades peripherally mounted thereon and spaced circumferentially thereof;

adjacent discs of said first plurality of discs defining spaces therebetween, adjacent discs of said second plurality of discs defining spaces therebetween, and said first and second parallel shafts relatively positioned with respective discs of said first plurality of discs inserted between adjacent discs of said second plurality of discs and with respective discs of said second plurality of discs inserted between adjacent discs of said first plurality of discs;

a plurality of stationary spacers each mounted between a respective adjacent pair of discs in one plurality of discs and opposite a corresponding disc in the other plurality of discs, each of said spacers having a thickness slightly less than its corresponding disc and having a peripheral contour defining a guide surface leading down toward said first and second plurality of discs and an arcuate surface opposite and adjacent the corresponding disc and extending upwardly toward and meeting said guide surface at a certain angle, said guide surface and said arcuate surface meeting at an edge defining a cutting edge on said spacer, and said cutting edge of said spacer being positioned close to the circular locus of the outermost portions of said shredding blades;

whereby rotation of said first and second parallel shafts in opposite directions and in directions so that said shredding blades first approach said cutting edges and then sweep past said arcuate surfaces of said spacers is effective to shred documents inserted between said first plurality and said second plurality of rotating discs, wherein each such document is first cut into a plurality of strips by a shearing action between said first plurality of rotating discs and said second plurality of rotating discs, said strips being formed between adjacent pairs of said first plurality of rotating discs and between adjacent pairs of said second plurality of rotating discs, and each of said strips then being guided by the guide surface of a corresponding spacer to advance between the cutting edge of the corresponding spacer and the shredding blades of the rotating disc opposite the corresponding spacer, and successive fragments being successively cut from each advancing strip as successive shredding blades sweep past the cutting edges and the arcuate surfaces as the corresponding discs rotate.

2. A document shredder according to claim 1, wherein the cutting edge of each spacer is a straight edge extending transversely across each spacer.

3. A document shredder according to claim 1, wherein the shredding blade of each disc is a straight blade parallel to said pair of parallel shafts.

* * * * *